United States Patent [19]

Schwarzfeller et al.

[11] Patent Number: 4,910,933

[45] Date of Patent: Mar. 27, 1990

[54] POST FOR ENCLOSURES

[75] Inventors: Holger Schwarzfeller, Düsseldorf-Eller; Werner Brand, Hagen; Gerhard Rohr, Schwerte; Heinz Werner, Warstein, all of Fed. Rep. of Germany

[73] Assignees: Hoesch Aktiengesellschaft, Dortmund; Schwarzfeller Draht & Zaun GmbH, Düsseldorf, both of Fed. Rep. of Germany

[21] Appl. No.: 184,939

[22] Filed: Apr. 22, 1988

[30] Foreign Application Priority Data

Apr. 24, 1987 [DE] Fed. Rep. of Germany ..... 3713707

[51] Int. Cl.[4] ..... E04B 1/00

[52] U.S. Cl. ..... 52/282; 52/468; 52/737

[58] Field of Search ..... 52/241, 256, 301, 730, 52/731, 732, 358, 239, 282, 468

[56] References Cited

U.S. PATENT DOCUMENTS 3,034,609 5/1962 Young ..... 52/730

3,553,916 1/1971 Lickliter et al. ..... 52/731

3,686,810 8/1972 Allen ..... 52/731

*Primary Examiner*—David A. Scherbel

*Assistant Examiner*—Michele A. Van Patten

*Attorney, Agent, or Firm*—Max Fogiel

[57] ABSTRACT

To create a post for enclosures, partitions, and similar structures consisting of several parts and involving a strip of hollow structural section that will allow the rapid and rational assembly of such enclosures as bar-grid fences and similar structures, whereby disassembly will be impossible without destroying the components, the length (2) of hollow structural section has a gap along one side flanked by two separated flanges (3), which extend either inward or outward and between which are accommodated webs (4) that match the shape of each flange and that are part of a length (5) of more or less T or $\pi$-shaped structural section that closes off the gap, leaving room outside on each side of the flanges between the length of hollow structural section and the matching sections of a spine (6) on a length (5) of T or $\pi$-shaped structural section, whereby the length of T or $\pi$-shaped structural section can be locked into the length of hollow structural section.

26 Claims, 7 Drawing Sheets

POST FOR ENCLOSURES

The invention concerns a post for enclosures, partitions, and similar structures consisting of several parts and involving a strip of hollow structural section.

Posts for wire-grid fences and consisting of rectangular pipes with welded-on tabs that the wire grid can be secured to with compression strips and screws are known. There is, however, a drawback to the known posts in that the fence can always be disassembled by unauthorized persons and accordingly rendered penetrable. Assembly also takes a lot of time.

The object of the present invention is accordingly to create a post of the type initially described that will allow the rapid and rational assembly of such enclosures as bar-grid fences and similar structures, whereby disassembly will be impossible without destroying the components.

The object is attained in accordance with the invention by the characteristics recited in the body of claim 1.

Practical developments are recited in claims 2 through 13.

The particular advantages of the post in accordance with the invention are that it allows simple and rapid assembly of bar-grid fences and similar structures for example but can be rendered penetrable only by destroying its components, a property that satisfies strict security demands in that it has no separable components like screws, rivets, securing tabs, etc. for example.

Figure 1:
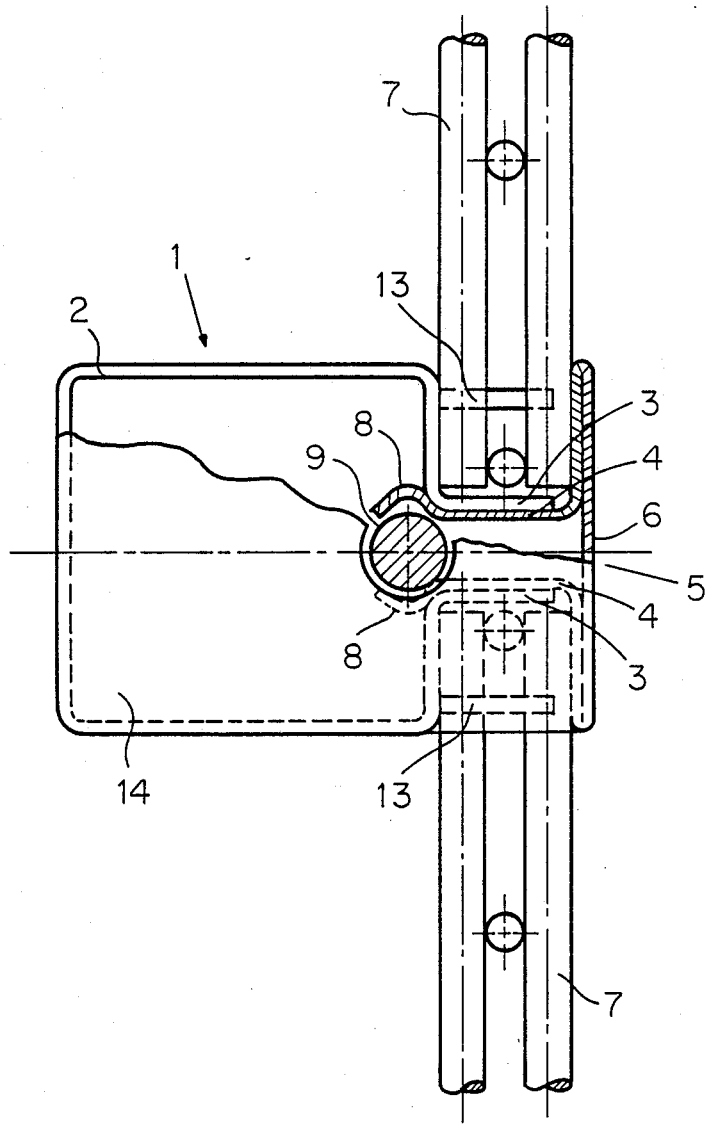
Figure 2:
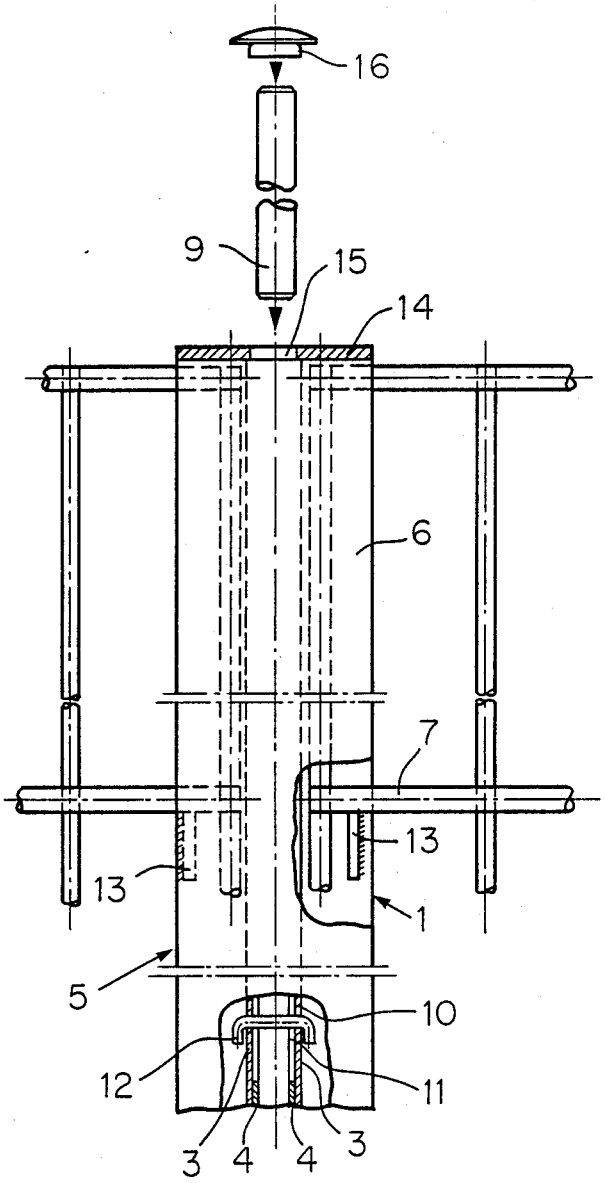
Figure 3:
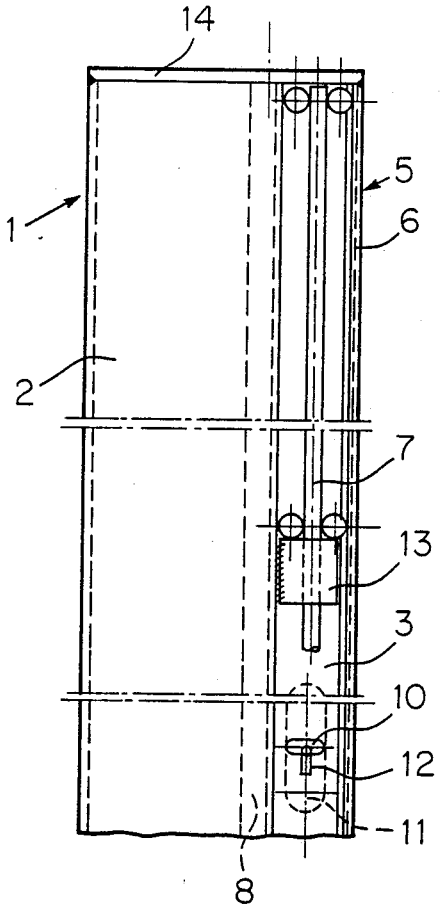
Figure 4:
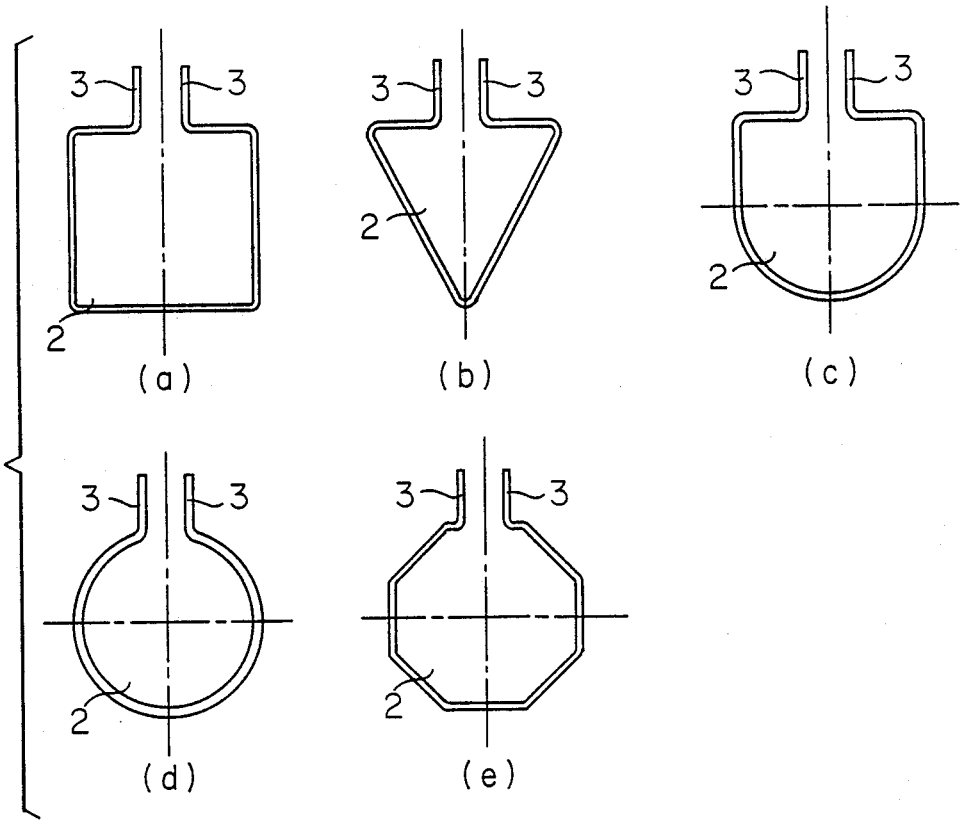
Figure 5:
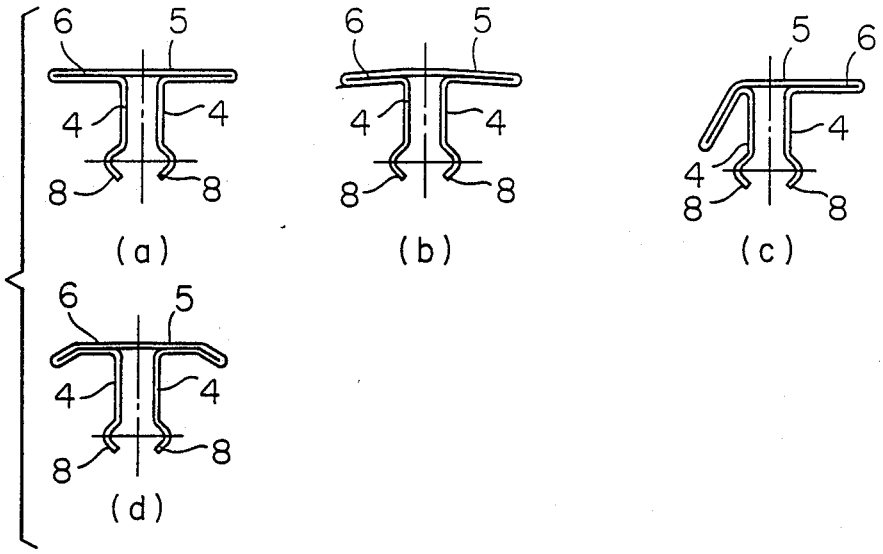
Figure 6:
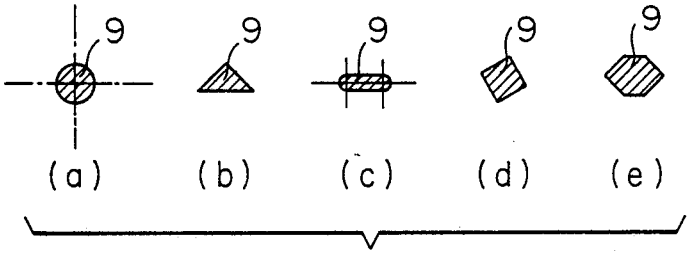
Figure 7:
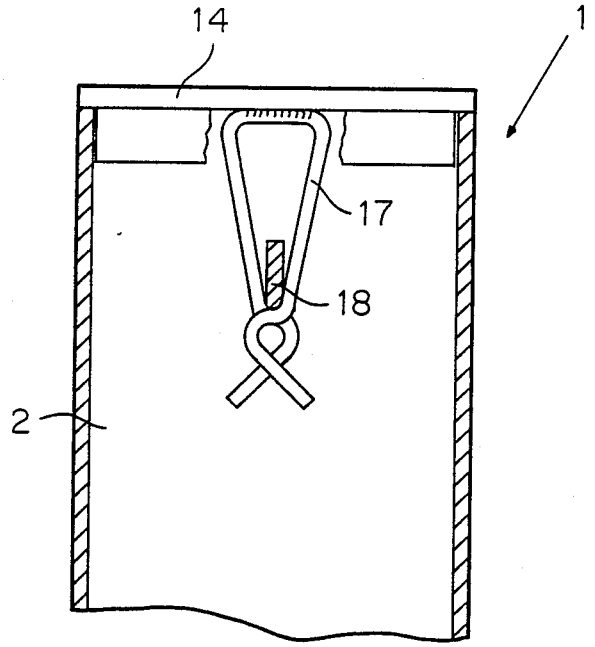
Figure 8:
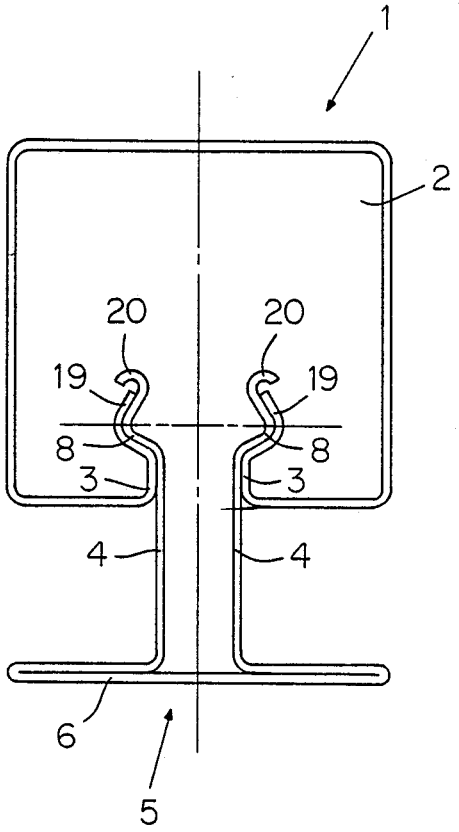

The post in accordnce with the invention will now be specified with reference to the drawing, wherein FIG. 1 is a top view of one embodiment of an assembled post, FIG. 2 is a front view of the post in FIG. 1, FIG. 3 is a side view of the posts in FIGS. 1 and 2, FIG. 4 illustrates various embodiments of the hollow structural section that the post is made out of, FIG. 5 illustrates various embodiments of the $\pi$-shaped structural section that is employed with the post, FIG. 6 illustrates various embodiments of the rod that secures the post, FIG. 7 illustrates an embodiment of a top for the post, and FIG. 8 is a top view of another embodiment of an assembled post.

As will be evident from FIGS. 1 through 3, a post 1 consists of a length 2 of hollow square structural section with a gap along one side flanked by two separated and outwardly extending flanges 3, between which are accommodated webs 4 that match the shape of each flange and that are part of a length 5 of T-shaped or $\pi$-shaped structural section that closes off the gap, leaving room for bar grids 7 on each side of flanges 3 between length 2 of hollow structural section and the matching sections of a spine 6 on a length 5 of $\pi$-shaped structural section, whereby spine 6 is as wide as length 2 of hollow structural section.

The ends of webs 4 extend into length 2 of hollow structural section and have recesses 8 toward the inside of the wall of length 2, with their ends facing each other again and mutually partly surrounding one or more locking rods 9 accommodated between them, securing length 5 of $\pi$-shaped structural section into length 2 of hollow structural section.

The flanges 3 on length 2 of hollow structural section and the webs 4 on length 5 of $\pi$-shaped structural section have matching slots 10 and 11 for accommodating a suspendable U-shaped bolt 12 that provides additional security to prevent spreading length 2 of hollow structural section open and secures length 5 of $\pi$-shaped structural section. The slots 11 in the webs 4 on length 5 of $\pi$-shaped structural section extend along post 1 and the slots 10 in the flanges 3 on length 2 of hollow structural section extend across the post. Slots 11 are as wide and slots 10 as long as the legs of U-shaped bolt 12.

Tabs 13 are welded to the sides of length 2 of hollow structural section that face the spine 6 on length 5 of $\pi$-shaped structural section and prevent the grid from being extracted.

Welded to the top of post 1 is a face plate 14 that has an opening 15 to insert locking rod 9 through and that can be closed off with a cap 16.

To assemble the fence, bar grids 7 are suspended over the tabs 13 on lengths 2 of hollow structural section that have been anchored into the ground, matching lengths 5 of $\pi$-shaped structural section are inserted to prevent bar grids 7 from falling out and collapsing, locking rods 9 are inserted through the openings 15 in face plates 14, and the openings are closed off with caps 16, preventing the fence from being disassembled without destroying its components.

FIG. 4 illustrates various embodiments of length 2 of hollow structural section with flanges 3:

(a) quadrilateral,
(b) triangular,
(c) half-round,
(d) round, and
(e) polygonal, whereby flanges 3 can point inward, although the situation is not illustrated.

FIG. 5 illustrates various embodiments of length 5 of $\pi$-shaped structural section with webs 4, spine 6, and recesses 8, whereby (a) has a flat spine 6,
(b) has a spine 6 that is bent slightly on both sides along its total length,
(c) has a spine 6, intended for example for a terminal post, that is bent all the way in on one side, and
(d) has a spine 6 that is bent slightly in only at edges.

FIG. 6 illustrates various embodiments of locking rod 9:

(a) round,
(b) triangular,
(c) oblong,
(d) square, and
(e) polygonal.

FIG. 7 represents a face plate 14 that snaps into the top of post 1 and cannot be removed from it. Welded to the inner surface of face plate 14 is a spring-loaded clip 17 that operates in conjunction with a transverse rib 18 welded into length 2 of hollow structural section to reinforce it.

FIG. 8 illustrates a post 1 with a length 2 of hollow structural section that has flanges 3 that face inward with webs 4 that match the flanges positioned between them. The webs are part of a length 5 of $\pi$-shaped structural section with a spine 6. The recesses 8 on webs 4 engage matching recesses 19 in the flanges 3 on length 2 of hollow structural section, and the webs 4 also have recesses 20 that engage the ends of flanges 3.

To improve protection against corrosion, posts 1 are made out of corrosion-resistant and/or coated materials.

The posts in accordance with the invention can of course also be employed in partitions, balustrades, wind, sun, antiglare, antinoise, and privacy screens, to construct containers, frameworks, connecting systems, ceiling suspension systems, and built-in cabinets, and in the automotive industry etc.

We claim:

1. A post for enclosures, partitions, and similar structures comprising: a hollow member with a structural section and a length: two separated flanges on said structural section, said structural section having a gap along one side between said flanges; a substantially $\pi$-shaped structural section closing off said gap and having webs located between said flanges and positioned against said flanges; a spine section on said $\pi$-shaped structural section and extending over said one side in spaced relation from said one side; said spine section, flanges and said one side of said structural section defining spaces; a plurality of locking rods spaced from each other and extending into said spaces; said $\pi$-shaped structural section being lockable into said hollow member by said locking rods for preventing disassembly of said post without destroying parts of said post; nonremovable cover means on top of said hollow member; and welded projections on a side of said post for preventing removal of a fence supported by said post.

2. A post as defined in claim 1, wherein said hollow member has an inside wall; said webs extending inside said hollow member with profiled end portions facing said inside wall.

3. A post as defined in claim 2, including at least one locking rod between said profiled portions, said profiled portions being shaped for surrounding partly said locking rod.

4. A post as defined in claim 2, wherein said profiled end portions of said webs match coresponding profiled portions in said flanges.

5. A post as defined in claim 4, wherein said webs have profiled ends also engaging profiled ends of said flanges.

6. A post as defined in claim 1, wherein said spine section has a longitudinal axis and a bent on both sides of said longitudinal axis.

7. A post as defined in claim 1, wherein said spine section is bent on one side toward interior of said post.

8. A post as defined in claim 1, wherein said hollow member has a width, said spine being substantially as wide as said width of said hollow member.

9. A post as defined in claim 1, including a suspendable U-shaped bolt, said flanges and said webs having matching slots distributed along said post for receiving said U-shaped bolt.

10. A post as defined in claim 1, including fastener means formed from surfaces of said spine section.

11. A post as defined in claim 1, wherein said post is comprised of corrosion-resistnt materials.

12. A post for enclosures, partitions, and similar structures comprising: a hollow member open on one side; two separated flanges mounted on said side; webs lying against said flanges and closing said side; said webs being part of a substantially $\pi$-shaped section; said webs covering substantially said flanges; said webs extending into said hollow member and having profiled end portions facing inner side walls of said hollow member; said $\pi$-shaped member having a spine section, intermediate space being located between said hollow member and said spine section, nonremovable cover means on top end of said hollow member and covering said intermediate space; a plurality of locking rods spaced from each other and located on sides of said flanges opposite to sides of said flanges lying against said webs; said $\pi$-shaped section being lockable into said hollow member by said locking rods for preventing disassembly of said post without destroying parts of said post; and welded projections on a side of said post for preventing removal of a fence supported by said post.

13. A post as defined in claim 12, wherein said spine section has inner surfaces facing said hollow member; and bolts formed integrally with at least one of said inner surfaces of said spine section.

14. A post as defined in claim 12, wherein said spine section has one side bent toward interior of said post.

15. A post as defined in claim 12, wherein said spine section has a width corresponding substantially to the width of said hollow member.

16. A post as defined in claim 12, wherein said profiled end portions of said webs cooperate with corresponding profiled portions in said flanges.

17. A post as defined in claim 12, wherein ends of said webs have additional profiled portions and the ends of said flange have profiled portions extending thereover.

18. A post as defined in claim 12, including at least one locking rod, said profiled end portions of said webs being shaped so that they surround partly said locking rod.

19. A post as defined in claim 12, wherein said spine section has two side bent substantially toward interior of said hollow member.

20. A post as defined in claim 12, wherein said post is comprised of corrosion-resistant materials.

21. A post for enlosures, partitions, and similar structures comprising: a hollow member open on one side; two separated flanges on said hollow member and mounted on said side; webs lying against said flanges and closing said side; said webs being part of a substantially $\pi$-shaped section; said webs covering substantially said flanges; said webs extending into said hollow member and having end portions facing inner side walls of said hollow member; said $\pi$-shaped member having a spine section, intermediate space being located between said hollow member and said spine section; nonremovable cover means on top end of said hollow member and covering said intermediate space; a plurality of locking rods spaced from each other and located on sides of said flanges opposite to sides of said flanges lying against said webs; said $\pi$-shaped section being lockable into said hollow member by said locking rods for preventing disassembly of said post without destroying parts of said post; welded projections on a side of said post for preventing removal of a fence supported by said post; said spine section having a width corresponding substantially to the width of said hollow member; said webs having recesses cooperating with corresponding recesses in said flanges; said flanges having recesses extending over said end portions of said webs; said end portions of said webs being shaped so that they surround partly at least one locking rod; a suspendable U-shaped bolt, said post having a length; said flanges and said webs having elongated slots distributed along said length of said post for receiving said U-shaped bolt; said post having a longitudinal axis, slots in said webs being directed parallel to said longitudinal axis, slots in said flanges being directed transverse to said longitudinal axis, slots in said flanges matching flanges of said U-shaped bolt, said flanges of said U-shaped bolt having a length, slots in said webs having a width corresponding substantially to said length of the flanges of said U-shaped bolt; said spine section having inner surfaces facing said hollow member, bolts formed integrallly with at least one of said inner surfaces of said spine section; said spine section having two sides bent substantially toward interior of said post; said post being comprised of corrosion-resistant materials.

22. A post for enclosures, partitions, and similar structures comprising: a hollow member with a structural section and a length; two separated flanges on said structural section, said structural section having a gap along one side between said flanges; a substantially $\pi$-shaped structural section closing off said gap and having webs located between said flanges and positioned against said flanges; a spine section on said $\pi$-shaped structural section and extending over said one side in spaced relation from said one side; said spine section, flanges and said one side of said structural section defining spaces; a plurality of locking rods spaced from each other and extending into said spaces; said $\pi$-shaped structural section being lockable into said hollow member by said locking rods for preventing disassembly of said post without destroying parts of said post; nonremovable cover means on top of said hollow member; and welded projections on a side of said post for preventing removal of a fence supported by said post; a suspendable U-shaped bolt, said flanges and said webs having matching slots distributed along said post for receiving said U-shaped bolt.

23. A post as defined in claim 22, wherein said webs have slots extending along said post and said flanges have slots extending across said post and said flanges, said slots in said flanges having dimensions substantially equal to the legs of said U-shaped bolt.

24. A post for enclosures, partitions, and similar structures comprising: a hollow member with a structural section and a length; two separated flanges on said structural section, said structural section having a gap along one side between said flanges; a substantially $\pi$-shaped structural section closing off said gap and having webs located between said flanges and positioned against said flanges; a spine section on said $\pi$-shaped structural section and extending over said one side in spaced relation from said one side; said spine section, flanges and said one side of said structural section defining spaces; a plurality of locking rods spaced from each other and extending into said spaces; said $\pi$-shaped structural section being lockable into said hollow member by said locking rods for preventing disassembly of said post without destroying parts of said post; nonremovable cover means on top of said hollow member; welded projections on a side of said post for preventing removal of a fence supported by said post; a transverse rib welded inside said hollow member; a spring-loaded clip secured to said transverse rib; said cover means on top of said hollow member being held in position by said spring-loaded clip so that said cover means is not removable, said cover means covering said gap along said side flanked by said flanges and bordered by said spine section.

25. A post for enclosures, partitions, and similar structures comprising: a hollow member open on one side; two separated flanges on said structural section mounted on said side; webs lying against said flanges and closing said side; said webs being part of a substantially $\pi$-shaped section; said webs covering substantially said flanges; said webs extending into said hollow member and having end portions facing inner side walls of said hollow member; said $\pi$-shaped member having a spine section, intermediate space being located between said hollow member and said spine section; nonremovable cover means on top end of said hollow member and covering said intermediate space; a plurality of locking rods spaced from each other and located on sides of said flanges opposite to sides of said flanges lying against said webs; said $\pi$-shaped section being lockable into said hollow member by said locking rods for preventing disassembly of said post without destroying parts of said post; welded projections on a side of said post for preventing removal of a fence supported by said post; a suspendable U-shaped bolt, said post having a length, said flanges and said webs having elongated slots distribute along said length of said post for receiving said U-shaped bolt.

26. A post as defined in claim 25, wherein said post has a longitudinal axis, slots in said webs being directed parallel to said longitudinal axis, slots in said flanges being directed transverse to said longitudinal axis, slots in said flanges matching flanges of said U-shaped bolt, said flanges of said U-shaped bolt having a length, slots in said webs having a width corresponding substantially to said length of the flanges of said U-shaped bolt.

* * * * *